US005277336A

United States Patent [19]

Youel

[11] Patent Number: 5,277,336

[45] Date of Patent: Jan. 11, 1994

[54] DEVICE FOR THE PRESSURIZED DISPENSING OF A PRODUCT, ESPECIALLY A FOAMING PRODUCT, AND PROCESSES FOR FILLING A CONTAINER FOR A DEVICE OF THIS KIND

[75] Inventor: Jean-Pierre Youel, Colombes, France

[73] Assignee: L'Oreal, Paris, France

[21] Appl. No.: 68,299

[22] Filed: May 28, 1993

Related U.S. Application Data

[62] Division of Ser. No. 814,561, Dec. 30, 1991, abandoned.

[30] Foreign Application Priority Data

Dec. 31, 1990 [FR] France ..... 90 16539

[51] Int. Cl.[5] ..... B65D 83/62

[52] U.S. Cl. ..... 222/105; 222/107; 222/131; 222/402.1; 222/394

[58] Field of Search ..... 222/95, 105, 107, 131, 222/386.5, 387, 389, 394, 402.1, 402.16; 239/323, 337

[56] References Cited

U.S. PATENT DOCUMENTS

| | | | |
|---|---|---|---|
| 3,342,377 | 9/1967 | Peredy | 222/107 X |
| 3,378,169 | 4/1968 | Clark | 222/95 |
| 3,662,926 | 5/1972 | Umstead | 222/95 |
| 4,117,951 | 4/1977 | Winckler | 222/95 X |
| 4,150,522 | 4/1979 | Burger | 222/402.1 X |
| 4,189,069 | 2/1980 | Stoody | 222/105 X |

FOREIGN PATENT DOCUMENTS

| | | |
|---|---|---|
| 0017147 | 10/1980 | European Pat. Off. . |
| 2233843 | 10/1975 | France . |
| 2281290 | 5/1976 | France . |

*Primary Examiner*—Andres Kashnikow
*Assistant Examiner*—Kenneth Bomberg
*Attorney, Agent, or Firm*—Cushman, Darby & Cushman

[57] ABSTRACT

The device comprises a container (3) provided in its upper part with an opening (4) fitted with a distribution valve (11), and a flexible pouch (9) disposed in the interior of the said container (3) in order to form a partition between the product (2) to be dispensed and a propellant (14) capable of maintaining a sufficient internal pressure for dispensing the product. The active product (2) to be dispensed is situated in the interior of the flexible pouch (9) and the valve (11) does not have a dip tube. A quantity of propellant (14) is introduced into the volume (10) of the container (3) situated around the flexible pouch (9). The flexible pouch (9) is made of a membrane which is sufficiently permeable to allow for the maintenance of an equilibrium of the gaseous pressure of the propellant (14) between the volume (10) exterior to the pouch (9) and the interior of this pouch (9).

6 Claims, 7 Drawing Sheets

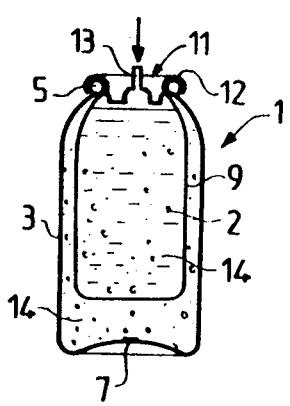
FIG. 3a
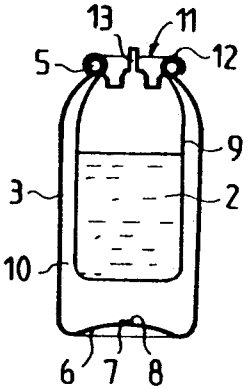
FIG. 3b
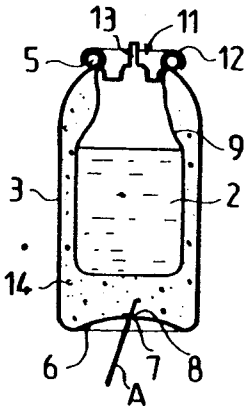
FIG. 3c
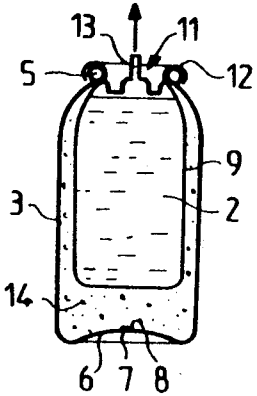
FIG. 3d
FIG. 3e
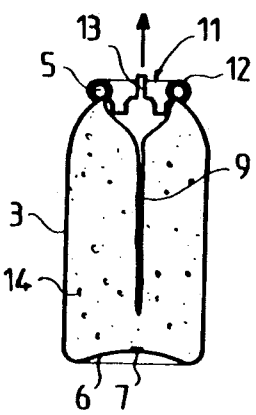
FIG. 4a
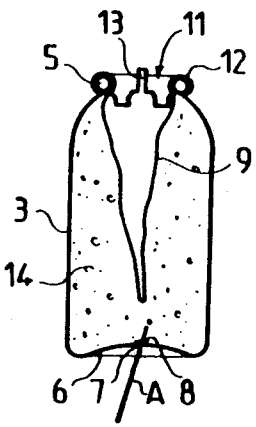
FIG. 4b
FIG. 4c
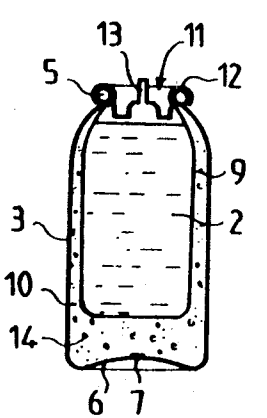
FIG. 4d
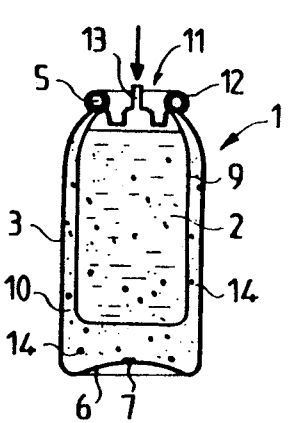
FIG. 4e

DEVICE FOR THE PRESSURIZED DISPENSING OF A PRODUCT, ESPECIALLY A FOAMING PRODUCT, AND PROCESSES FOR FILLING A CONTAINER FOR A DEVICE OF THIS KIND

This is a continuation of application Ser. No. 07/814,561, filed on Dec. 30, 1991, which was abandoned upon the filing hereof.

FIELD OF THE INVENTION

The invention relates to a device for the pressurised dispensing of a product, especially a foaming product such as shaving foam or make-up removing foam, or a hair product, of the type comprising a container provided in its upper part with an opening fitted with a distribution valve, and a gas-permeable flexible pouch disposed in the interior of this container in order to form a partition between the product to be dispensed and a propellant means capable of maintaining a sufficient internal pressure for dispensing the product.

DESCRIPTION OF THE PRIOR ART

The propellant means may consist of a liquid-steam equilibrium within the conventional temperature range, by means of which it is possible to obtain the desired pressure.

A device of this type is known from FR-2 281290. This device serves to dispense a product in aerosol form and consists of the combination of a dispenser having a high volume and a dispenser having a low volume, wherein these two dispensers can communicate with one another. Whereas the first dispenser having a high volume contains a gas-permeable pouch containing the product to be dispensed and the first propellant liquid, the second dispenser having a small volume and formed by the space between the pouch and the container of the device contains a second propellant liquid under a lower pressure than the propellant liquid contained in the pouch. In this known device, part of the first propellant mixed with the product to be dispensed passes through the wall of the pouch to be mixed with the second propellant liquid. This means that the pressure in the pouch containing the product to be dispensed decreases and that the pressure in the space surrounding the pouch increases until there is an equilibrium. The disadvantage of this device is that the concentration of propellant liquid in the product to be dispensed decreases during dispensing.

Moreover, the document FR-A-2233843 describes a device in which two different propellants are used, a first propellant dissolved in the product to be dispensed, preferably contained in a gas-permeable pouch, and a second propellant contained in the space surrounding the pouch. The gas contained in the product to be dispensed traverses the wall of the pouch to be mixed with the second propellant until the pressures in the interior and to the exterior of the pouch are balanced. Here once again, the concentration of propellant liquid in the product to be dispensed decreases during dispensing.

Another device is known from the document EP-A-0017147. In this device, the active product to be dispensed is disposed in the interior of the flexible pouch, while the propellant means is situated in the part of the container to the exterior of the said pouch. With a device of this kind, the flow rate of the product between the commencement of use, when the device is filled with the product, and the end of use, when the device is virtually empty, does not remain as constant as may be desired. Moreover, in the case of an aerosol or a foaming product, the characteristics of the product dispensed also tend to vary between the commencement and the end of use. Finally, the device must be used in an upright position.

The object of the invention is above all to provide a device of the type defined hereinbefore, by means of which it is possible to obtain improved constancy of the flow rate and improved characteristics of the product dispensed between the beginning and the end of use of the device. It is moreover desired that the device can be used in any position, in particular upside down.

SUMMARY OF THE INVENTION

According to the invention, a device for the pressurised dispensing of an active product, especially a foaming product, a deodorant or a hair product, of the type defined hereinbefore, is characterised in that:

the active product to be dispensed is situated in the interior of the flexible pouch and the valve does not have a dip tube;

a quantity of propellant means is introduced into the volume of the container situated around the flexible pouch, this propellant means being identical to the one contained in the flexible pouch, and the flexible pouch is made of a membrane sufficiently permeable to allow for the maintenance of an equilibrium of the gaseous pressure of the propellant means between the volume exterior to the pouch situated in the container and the interior of this pouch, the propellant means in gaseous form passing from the said volume exterior to the pouch towards the interior of the said pouch.

The device of the invention takes advantage of the permeability of a membrane in order to maintain a gaseous equilibrium.

A device of this kind can be used for any products using aerosol technology such as body mousses, hair mousses, sprays such as deodorants, etc.. The product to be dispensed is situated in the interior of the flexible pouch.

The flexible pouch consists of a membrane sufficiently permeable to allow for the passage of the propellant means in gaseous form through the said membrane in order to balance the pressure of the propellant means between the interior of the pouch and the external part. The membrane of the pouch is of course impermeable with respect to the product remaining confined in the interior of this pouch.

The membrane of the pouch is advantageously made of one of the materials belonging to the group: polyethylene, polypropylene, polyethylene/terephthalate.

This membrane may consist of a combination of polyolefin and/or polyester films.

The thickness of the membrane of the pouch may be included between 0.2 and 0.6 mm, according to the nature of the material used to form the pouch.

The permeability to oxygen of the membrane forming the pouch is advantageously included between 150 $cm^3/m^2/24$ hours and 400 $cm^3/m^2/24$ hours.

The invention also relates to a process for filling a device such as the one defined hereinbefore for the pressurised dispensing of a product, especially a foaming product and/or a hair product.

According to a first possibility, a process of this kind is characterised in that:

the pouch is filled with the active product to be dispensed;

the valve is placed over the opening of the container and the pouch and then it is crimped on to the container;

a quantity of propellant means is introduced into the interior of the pouch by injection through the valve;

stirring may be effected;

another quantity of the same propellant means is injected into the part of the internal volume of the container situated to the exterior of the pouch, via an orifice provided in the container, generally in its lower part, and the pouch is drained by pressing the valve for several seconds.

According to another possibility, the filling process is characterised in that:

the pouch is filled with the active product;

the valve is placed over the opening of the container;

evacuation is effected in order to eliminate the air situated above the active product in the pouch;

the valve is crimped on to the edge of the opening of the container;

a quantity of propellant means is introduced into the interior of the pouch by injection through the valve;

another quantity of the same propellant means is introduced into the container to the exterior of the pouch, via an orifice provided in the wall of this container, especially in its lower part, and the pouch is drained by pressing the valve for one or two seconds.

According to a third possibility, the filling process is characterised in that:

the pouch is filled with the active product;

the valve is placed in position and crimped on to the container;

a quantity of propellant means is introduced into the container to the exterior of the pouch via an orifice provided in the wall of the container, especially in its lower part;

the pouch is drained by pressing the valve until the active product appears, and another quantity of the same propellant means is introduced into the interior of the pouch by injection through the valve.

According to a fourth possibility, the filling process is characterised in that:

the valve is placed on the container and on the pouch;

the valve is crimped on to the container;

a quantity of propellant means is introduced into the container to the exterior of the pouch via an orifice provided in the wall of the container, especially in its lower part;

the pouch is completely drained;

the active product is introduced into the interior of the pouch by injection through the valve, and another quantity of the same propellant means is introduced into the pouch by injection through the valve.

According to a fifth possibility, the filling process is characterised in that:

the valve is placed in position;

the valve is crimped on to the container;

a quantity of propellant means is introduced via an orifice situated in the wall of the container;

the active product to be dispensed is introduced into the pouch by injection through the valve;

another quantity of the same propellant means is introduced into the pouch by injection through the valve;

stirring may be effected, and the pouch is drained.

According to a final possibility, in the case of a container not having a filling orifice in its wall, the process is characterised in that:

a quantity of propellant means is introduced in the cold state into the interior of the container;

the pouch is introduced into the container and the valve is placed over the opening of the pouch and the container;

the valve is crimped on to the edge of the opening of the container;

the active product is introduced into the interior of the pouch by injection through the valve;

the pouch is drained, and another quantity of the same propellant means is introduced into the interior of the pouch by injection through the valve.

BRIEF DESCRIPTION OF THE DRAWINGS

In addition to the arrangements described hereinabove, the invention consists of a certain number of other arrangements which will be described in more detail hereinafter by way of non-limiting embodiments described with reference to the accompanying drawings, in which:

FIGS. 3*a* to 3*e* show a third possibility of filling and manufacture of the device;

FIGS. 4*a* to 4*e* show a fourth possibility of filling and manufacture;

DETAILED DESCRIPTION OF THE INVENTION

Figure 1A:
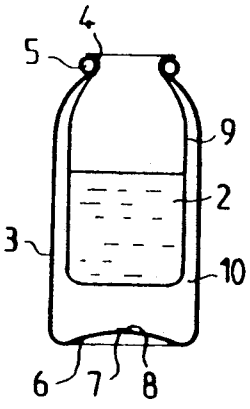
FIGS. 1*a* to 1*e* show in diagrammatic form the stages of a first process for filling and manufacturing a device for the pressurised dispensing of active product according to the invention.
Figure 1B:
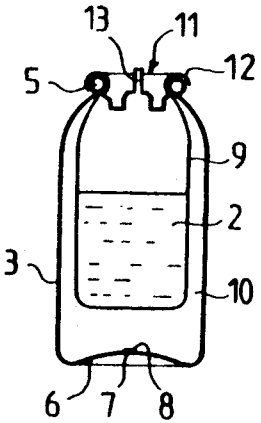
Figure 1C:
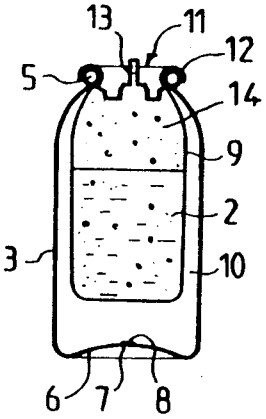
Figure 1D:
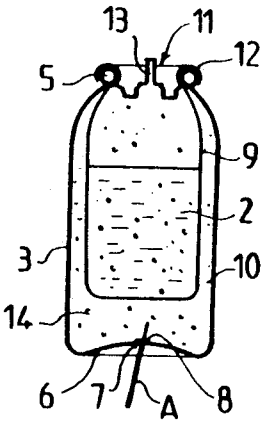
Figure 1E:
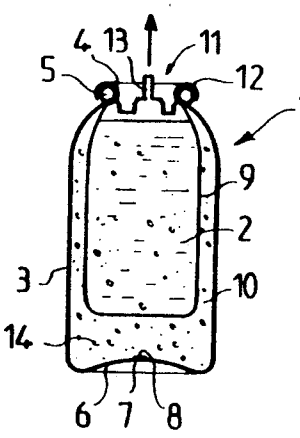

Referring to the drawings, especially FIG. 1*e*, they show a device 1 for the pressurised dispensing of an active product 2, e.g. a foaming product such as shaving foam, make-up removing foam, hair mousse or a spray product such as a deodorant.

The device 1 comprises a conventional container 3 in the form of a can, made of aluminium or tinplate or plastic material. As a variant, this container 3 may be made of glass.

The container 3 is provided in its upper part with an opening 4 defined by a peripheral bead 5 having a circular transverse section. If the container 3 is made of metal, this bead 5 can be formed by the rolled edge of the opening 4.

The container 3 comprises in its wall, preferably in the wall of the base 6, a filling orifice 7, closed by a filling plug 8 consisting, e.g. of a stopper of elastomeric material.

A flexible pouch 9 is disposed in the interior of the container 3, this pouch comprising in its upper part an opening limited by an edge which is applied in a sealed manner to the peripheral bead 5 defining the opening 4 of the container 3. In this manner, the part 10 situated in the interior of the container 3 and to the exterior of the pouch 9 is closed in a sealed manner.

A conventional distribution valve 11 is fixed in a sealed manner by crimping the edge of a cup 12 on to the peripheral bead 5. This valve 11 comprises an axial stem 13 adapted to be depressed by the user in order to open the said valve and dispense the product. The edge of the opening of the pouch 9 is sandwiched between the bead 5 and the edge of the cup 12.

The device 1, in view of its use, is provided with a distributor head (not shown) which covers the opening 4 and the distribution valve 11. This distributor head has a push-button which the user can press in order to depress the stem 13.

According to the invention, the active product 2 to be dispensed is situated in the interior of the flexible pouch 9 and the valve 11 does not have a dip tube.

A certain quantity of a propellant means 14 is introduced into the part 10 of the container 3 situated around the flexible pouch 9. This propellant means 14 may consist of a liquid-steam equilibrium capable of maintaining a sufficient pressure (approximately 3 bar) corresponding to the vapour pressure and the temperature in question of the liquid used. The propellant means 14 can be introduced into the part 10 with the aid of a hypodermic needle A inserted into the plug 8. When the needle A is removed, the plug 8 continues to ensure sealing.

Figure 12:
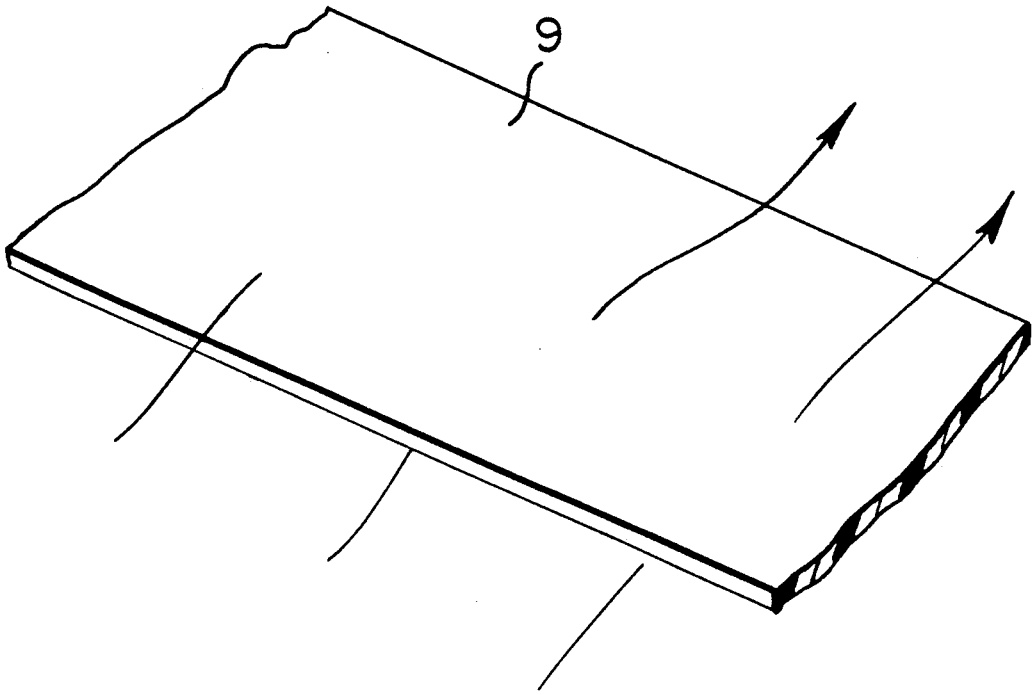
FIG. 12 is perspective view of a portion of the membrane pouch which is permeable to allow for the propellant to pass therethrough.

The flexible pouch 9 is formed by a membrane sufficiently permeable to allow for the passage of the propellant means in gaseous form through the said membrane in order to balance the pressure of the propellant means between the interior of the pouch 9 and the external part 10. This is shown schematically in FIG. 12 where the arrows represent the passage of the propellant through the pouch material 9. The membrane of the pouch 9 is of course impermeable with respect to the active product 2 remaining confined in the interior of this pouch.

The introduction of the active product into the pouch 9 can be effected through the valve 11. Moreover, a certain quantity of the same propellant means can be introduced into the pouch 9, also via the valve 11, particularly in order to expand the product to be dispensed.

It should be noted that the flexible pouch 9 can be fixed to the valve body 11 or even to the body of the container 3, or may even be wedged between the peripheral bead 5 and the cup 12 as described hereinbefore.

The pouch 9 may be made of one of the materials belonging to the group: polyethylene, polypropylene, polyethylene/terephthalate.

Figure 13:
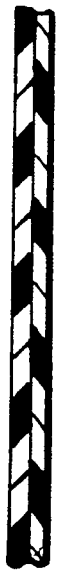
FIG. 13 is a sectional view of a portion of the pouch constructed from a combination of films.

According to another possibility, the pouch consists of a combination of polyolefin and/or polyester films as shown schematically in FIG. 13.

The thickness of the membrane forming the pouch 9 may be included between 0.2 and 0.6 mm, according to the nature of the material used to form this membrane.

The permeability of the pouch (membrane) to oxygen is advantageously included between 150 $cm^3/m^2/24$ hours and 400 $cm^3/m^2/24$ hours.

This pouch 9, which has a certain degree of permeability, allows the liquefied propellant means situated in the part 10 of the container 3 to ensure renewed supply in the gaseous phase of the active product 2 contained in the pouch 9 so that there is always oversaturation of the propellant in this pouch 9.

By virtue of the permeability of the pouch it is possible to obtain constancy of the flow rate of the active product and of the pressure in the pouch 9 during use, from the beginning to the end.

Figure 7:
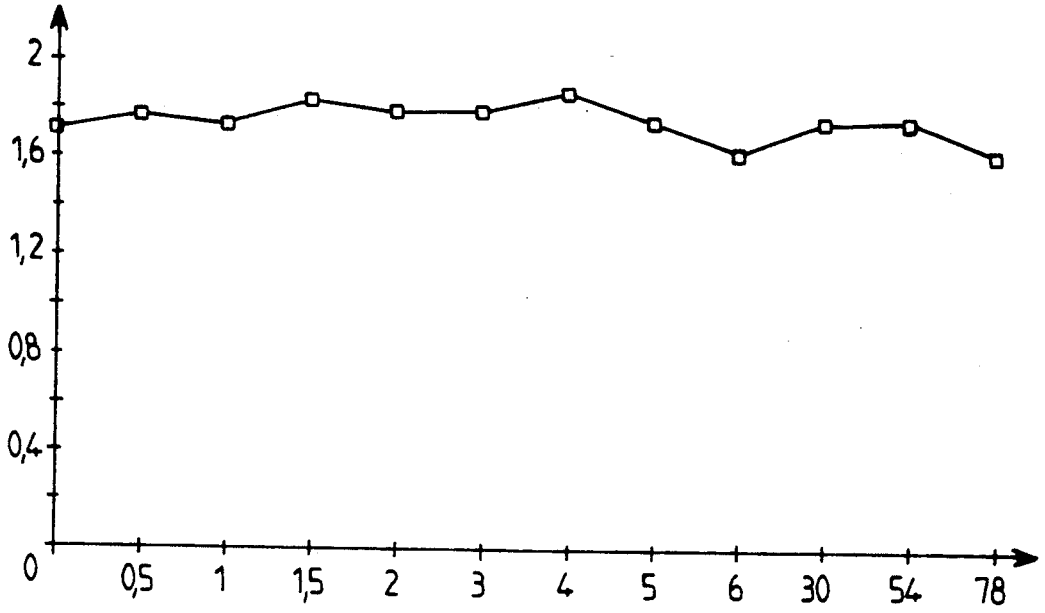
FIG. 7 is a graph showing the flow rate in grammes per second, plotted on the Y-axis, provided by a device according to the invention, as a function of the time plotted on the X-axis, each point corresponding to spraying for five seconds, this spraying being effected at spaced time intervals.

FIG. 7 and the following figures are graphs showing the results obtained with a device according to the invention during tests carried out with a foaming product. Some of these graphs make it possible to compare the results according to the invention with the results obtained with a device of the prior art.

FIG. 7 shows the variation of the flow rate in grammes/per second, plotted on the Y-axis, of a device according to the invention containing a body mousse, as a function of the time plotted on the X-axis. It should be noted that the scale of the X-axis is not a linear scale.

The tests consisted, with the aid of a device according to the invention filled with body mousse in the pouch 9, in pressing the stem 13 of the valve 11 for 5 s at spaced time intervals as shown on the X-axis, i.e. at the point 0, after half an hour, an hour, an hour and a half, two hours, three hours etc..

The product dispensed by the device is collected and weighed. The flow rate in grammes/second is obtained by dividing the mass collected by the expulsion time.

It would appear according to the graph that this flow rate is maintained at a substantially constant value of approximately 1.7 g/s, even after 78 hours.

Figure 8:
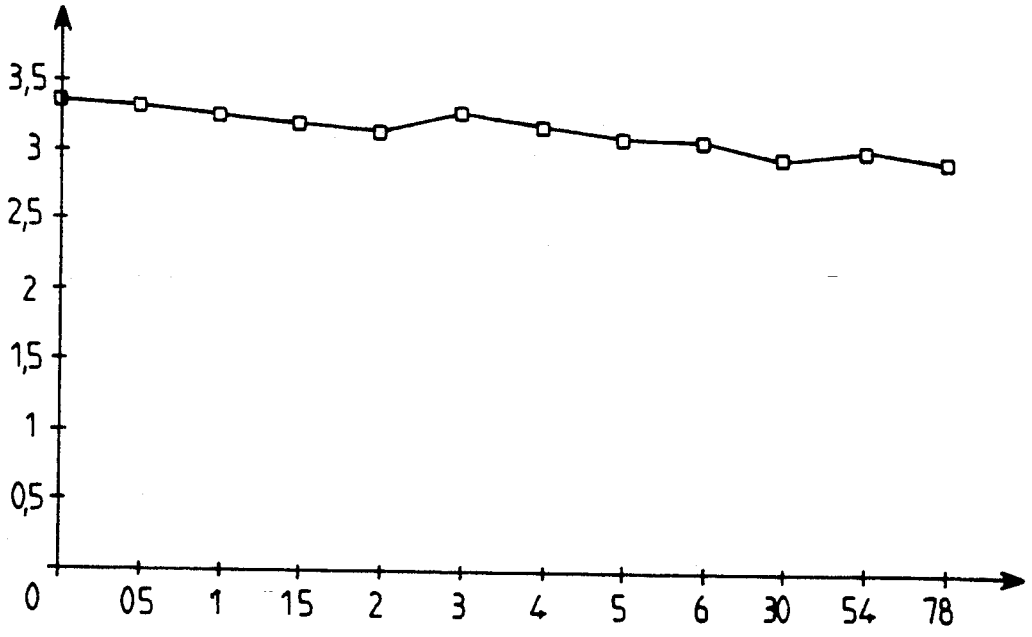
FIG. 8 is a graph showing the pressure variation in the pouch of a device according to the invention as a function of the time plotted on the X-axis.

The graph of FIG. 8 shows the pressure variations in bar, plotted on the X-axis, in the interior of the pouch 9 for the device of the invention having been subjected to the tests summarised by the graph of FIG. 7.

It would appear that the pressure remains relatively constant. At the commencement of use, this pressure is approximately 3.4 bar and after 78 hours it is still approximately 3 bar.

Figure 9:
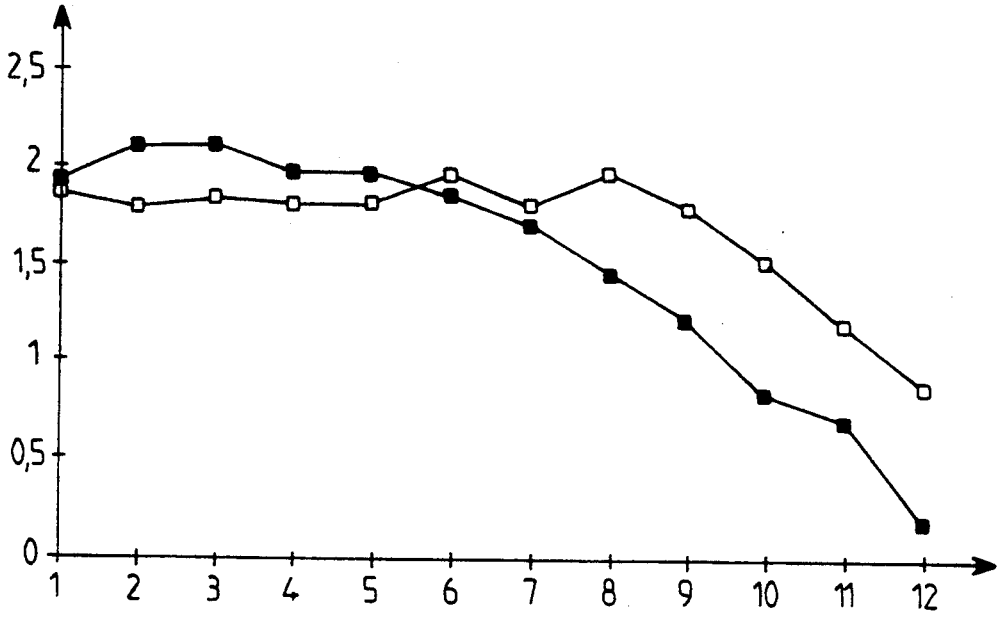
FIG. 9 is a comparative graph of the flow rate plotted on the Y-axis as a function of the number of dispensing operations plotted on the X-axis, for a device according to the invention and for a device according to the prior art.

The graph of FIG. 9 shows the results of comparative tests on a device according to the invention (measuring results plotted in the form of white squares) in which the pouch 9, having a certain degree of permeability, is made of PVC (polyvinyl chloride), and a device according to the prior art in which the flexible pouch is made of impermeable material (aluminium foil), the active product being situated in the interior of the pouch. The measuring points for the device of the prior art are shown by black squares in FIG. 9.

The flow rate in g/s is plotted on the Y-axis. Each measuring point corresponds to spraying for five seconds, successive spraying operations being spaced at intervals of 30 minutes. The number of spraying or dispensing operations is plotted on the X-axis.

It is clear that the flow rate of a device according to the invention varies much less markedly than the flow rate of a device according to the prior art.

The curve of the flow rate for the device of the invention is situated below the curve according to the prior art for the first five spraying operations, then is located above this other curve as from the sixth spraying operation. The drop in the flow rate according to the invention (from approximately 1.8 g/s for the first spraying operation to approximately 1.5 g/s for the tenth spraying operation) is much less marked when the number of spraying operations increases, than in the case of the prior art (from approximately 1.9 g/s for the first spraying operation to approximately 0.8 g/s for the tenth spraying operation).

Figure 10:
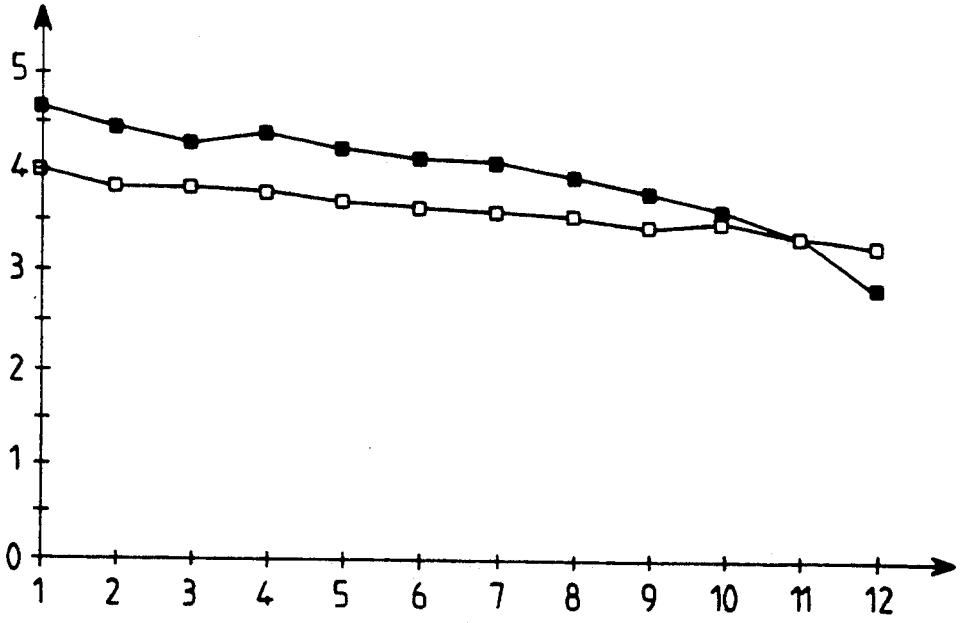
FIG. 10 is a comparative graph showing the pressure variation of the product plotted on the Y-axis as a function of the number of dispensing operations plotted on the X-axis in a device according to the invention and in a device of the prior art, and finally

FIG. 10 is a comparative graph comparing the device according to the invention used for the tests of FIG. 9 with a device according to the prior art, giving the development of the pressure in bar, plotted on the Y-axis, in the volume containing the active product as a function of the number of dispensing operations.

It would appear there too that the graph of the device according to the invention corresponding to the points represented by white squares is closer to constancy (variation limited between 4 bar and approximately 3.4 bar) than the graph of the device of the prior art represented by black squares (variation between approximately 4.6 bar and approximately 3 bar).

Figure 11:
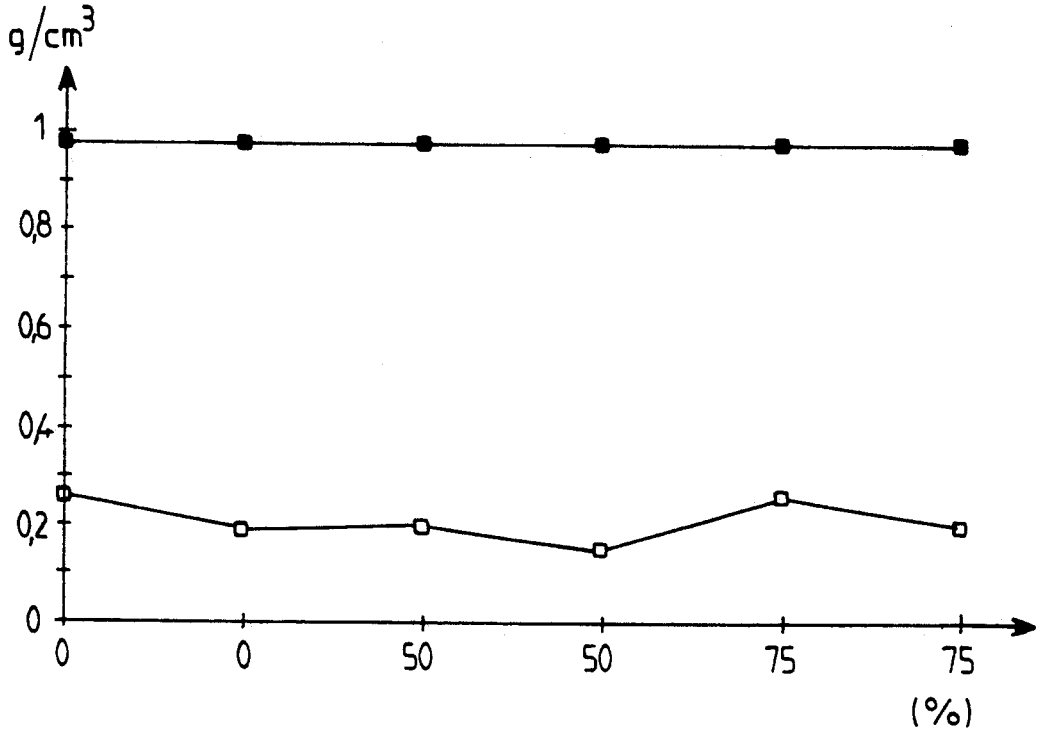
FIG. 11 is a graph giving the variations of the density of the product dispensed plotted on the Y-axis as a function of the rate of emptying plotted on the X-axis for a dispenser according to the prior art and for a device according to the invention under special conditions described hereinafter.

The graph of FIG. 11 summarises another type of comparative test carried out on a device according to the invention (measuring points represented by white squares) and a device according to the prior art (black squares).

For these tests, the volume containing the active product (intended to be foamed) is not filled with propellant means at the time of manufacture, In other words, in the case of the device according to the invention, for which the active product is situated in the pouch 9, there is no injection of propellant means into this pouch 9. For the device according to the prior art, in which the active product is situated in the interior of the flexible pouch, there is no injection of propellant means into this pouch.

The measurements the results of which are shown in FIG. 11 were carried out one week after manufacture of the device, i.e. this device was stored without being used for the week in question.

Two measurements of the density were taken in each test, one at the commencement of dispensing and the other after expansion of the foam, i.e. five minutes after delivery of the foam.

It would appear that the density of the product dispensed by a device according to the prior art after a week of storage remains constant as a function of the rate of emptying of this device. This density is moreover relatively high and corresponds to that of the non-expanded active product.

According to the invention, in a surprising manner, an expanded foam is obtained even although no propellant means is introduced into the volume containing the active product. Moreover, the density remains substantially constant during emptying.

With a device according to the invention, after a week of storage, there is sufficient diffusion of the propellant gas of the volume 10 towards the pouch 9 containing the active product.

According to the prior art, on the other hand, as the flexible pouch is impermeable, the propellant means contained in this pouch is not able to diffuse into the active product.

The manufacture and, more particularly, filling of a dispenser according to the invention may be effected by various processes which will be described hereinafter with reference to FIGS. 1*a*–1*e* and the following figures up to FIGS. 6*a*–6*e*.

According to a first possibility (FIGS. 1*a*–1*e*), as illustrated in FIG. 1*a*, once the pouch 9 is introduced into the container 3 this pouch is filled with the prescribed quantity of active product 2 to be dispensed (FIG. 1*a*).

The valve 11 is then placed over the opening of the pouch 9 and the container 3 and the cup 12 is crimped on to the edge 5 of the opening of the container, confining the upper edge of the pouch 9 in a sealed manner between the edge 5 and the part of the cup applied to this edge. This stage is illustrated by FIG. 1*b*.

A quantity of propellant means 14 is introduced into the interior of the pouch 9 by injection through the valve 11, as illustrated in FIG. 1*c*.

At this stage, the device may be stirred in order to promote mixing of the propellant means and the active product.

Another quantity of the same propellant means 14 is then injected into the part 10 of the internal volume of the container 3 situated to the exterior of the pouch 9, via the orifice 7. The injection can be effected with the aid of a hypodermic needle A inserted into the plug 8. This stage is illustrated in FIG. 1*d*.

The pouch 9 is then drained by pressing the stem 13 of the valve 11 for several seconds.

Figure 2A:
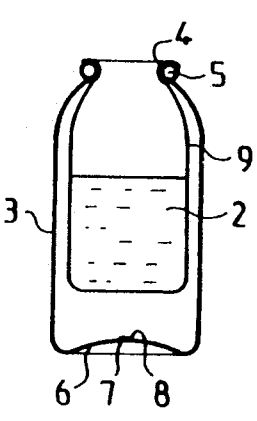
FIGS. 2*a* to 2*e* show a second possibility of filling and manufacture.

The container 1 shown in FIG. 1*e* is then ready to operate. According to another filling possibility illustrated in FIGS. 2*a*–2*e*, in a first stage (FIG. 2*a*), the pouch 9 is filled with the prescribed quantity of active product 2, as in the case of FIG. 1*e*.

Figure 2B:
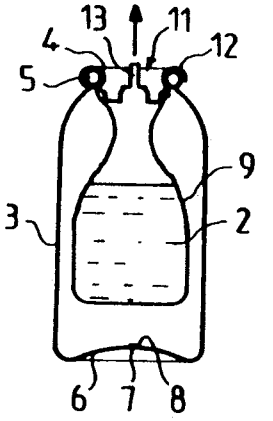
Figure 2C:
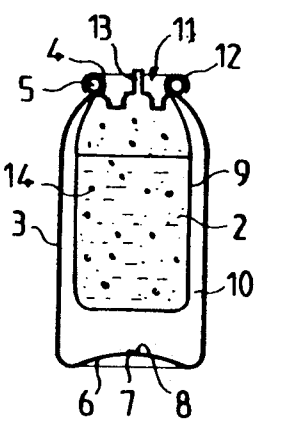

The valve 11 is then placed over the opening of the container 3 and evacuation is effected through this valve 11 into the pouch 9 in order to eliminate the air situated above the active product 2. This stage is illustrated in FIG. 2*b*.

The cup 12 is then crimped on to the edge 5 of the container and a quantity of propellant means 14 is introduced into the interior of the pouch 9 by injection through the valve 11. This stage corresponds to FIG. 2*c*.

Figure 2D:
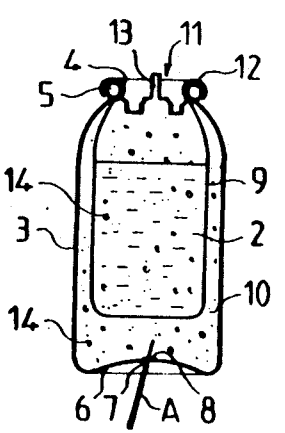

A quantity of the same propellant means 14 is then introduced through the orifice 7 into the volume situated to the exterior of the pouch 9, as illustrated in FIG. 2*d*.

Figure 2E:
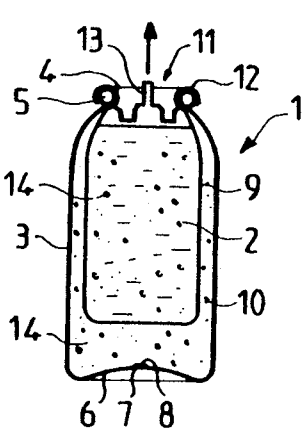

The pouch 9 is then drained by pressing the valve 11 for one or two seconds as illustrated in FIG. 2*e* and the device 1 is then ready to operate.

FIGS. 3*a*–3*e* show a third filling possibility.

FIGS. 3*a*, 3*b* correspond to stages identical to those of FIGS. 1*a*, 1*b* and they will not be described again.

The following stage of FIG. 3*c* corresponds to the introduction of a quantity of propellant means 14 into the volume 10 to the exterior of the pouch 9, this introduction being effected through the orifice 7.

The pouch 9 is then drained by pressing the valve 11 until the appearance of the active product. This stage corresponds to FIG. 3*d*.

Finally, a quantity of the same propellant means 14 is introduced into the interior of the pouch 9 by injection through the valve 11, resulting in the device 1 of FIG. 3*e* which is ready to operate.

According to a fourth possibility illustrated in FIGS. 4*a*–4*e*, in a first stage, once the pouch 9 has been introduced into the container 3, the valve 11 is placed over the opening of the container and the pouch and the cup 12 of the valve is crimped on to the edge 5.

A certain quantity of propellant means 14 is then introduced into the container 3, through the orifice 7, into the volume 10. The pressure exerted by the propellant compresses the pouch 9 as illustrated in diagrammatic form in FIG. 4*b*.

The air enclosed by the pouch 9 is then completely removed by pressing the valve 11. The walls of the pouch come to rest against one another as a result of the action of the pressure of the propellant means contained in the volume 10 and the air is expelled towards the exterior. This stage is shown in diagrammatic form in FIG. 4*c*.

The active product 2 is then introduced into the interior of the pouch 9 by injection through the valve 11. The state of the device at the end of this injection is illustrated in FIG. 4*d*.

Finally, a quantity of propellant means 14 is introduced into the pouch 9 by injection through the valve 11, resulting in the device ready to operate illustrated in FIG. 4*e*.

FIGS. 5*a*–5*e* show a fifth filling possibility.

Figure 5A:
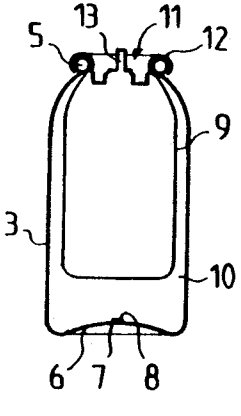
FIGS. 5*a* to 5*e* show a fifth possibility of filling and manufacture.
Figure 5B:
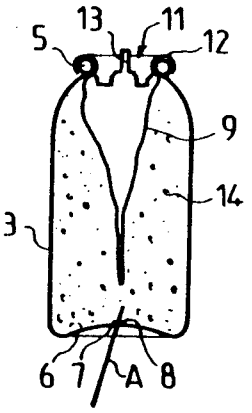

The stages shown in FIGS. 5*a* and 5*b* are identical to those of FIGS. 4*a* and 4*b* and they will not be described again.

Figure 5C:
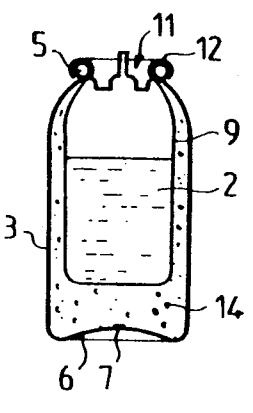

In the following stage, illustrated by FIG. 5*c*, the active product 2 is introduced into the pouch 9 by injection through the valve 11.

Figure 5D:
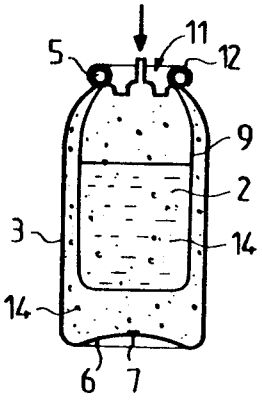

A quantity of propellant means 14 is then introduced into the pouch 9, also by injection, through the valve 11. FIG. 5*d* shows the device in diagrammatic form at the end of this injection.

Figure 5E:
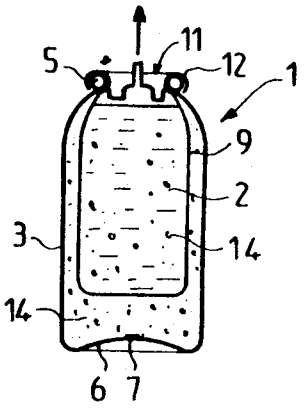

The pouch 9 is then drained by pressing the valve 11 so that the level of the active product 2, expanded by the propellant, comes close to the valve 11, as illustrated in FIG. 5*e*.

FIGS. 6*a*–6*e* show a filling possibility for a container 3*a* without the filling orifice of the preceding figures.

Figure 6A:
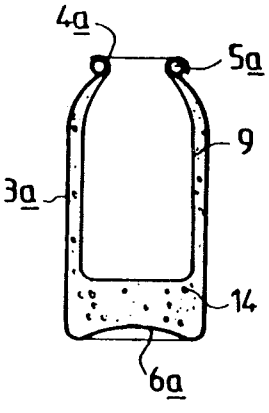
FIGS. 6*a* to 6*e* show a sixth possibility of filling and manufacture.
Figure 6B:
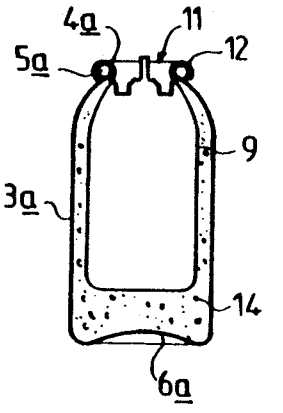

A quantity of propellant means 14 is introduced via the upper opening 4*a*of the container 3*a*, in the cold state, i.e. at a sufficiently low temperature so that the propellant means remains in the liquid state under atmospheric pressure. The pouch 9 is then introduced into the container 3*a*, then the valve 11 is placed over the opening 4*a* and the cup 12 is crimped on to the edge 5*a* as illustrated in FIG. 6*b*.

The propellant means 14 situated in the volume 10 is then confined in a sealed manner. It is no longer necessary to keep the container 3*a* at a low temperature.

Figure 6C:
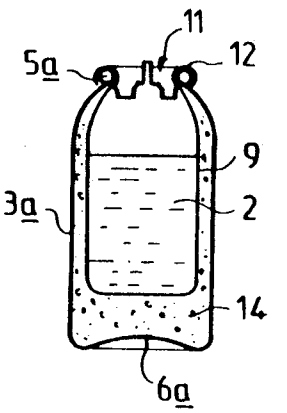

In the next stage, illustrated in FIG. 6*c*, the active product 2 is introduced into the interior of the pouch 9 by injection through the valve 11.

Figure 6D:
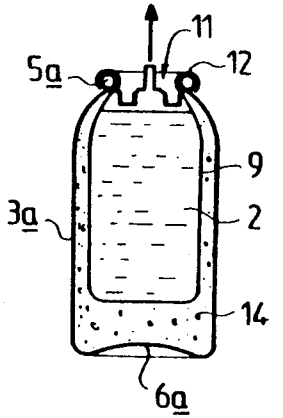
Figure 6E:
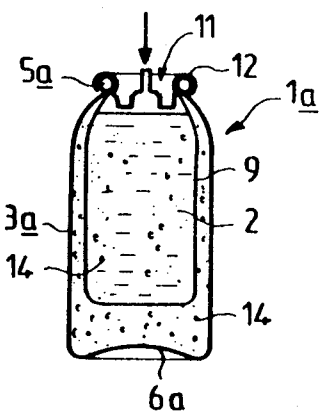

The pouch 9 is then drained by actuating the valve 11, as illustrated in FIG. 6*d*.

A quantity of propellant means 14 is then injected through the valve 11 into the interior of the pouch 9. The device 1*a* is ready to operate.

The invention provides a device for the pressurised dispensing of a product, which may be used in an upright position and upside down and which ensures good constancy of the flow rate, and excellent characteristics of the product dispensed.

I claim:

1. A device for the pressurized dispensing of a product comprising a container having an upper part with an opening fitted with a distribution valve, and a flexible pouch disposed in an interior of said container, the product to be dispensed being situated in the interior of said flexible pouch; a propellant means being present in said flexible pouch and in a volume of the container situated around the flexible pouch, said flexible pouch being made of a membrane sufficiently permeable to allow the propellant means in gaseous form to pass from the volume exterior of said pouch to the interior of said pouch, to maintain an equilibrium of gaseous pressure of the propellant means between the volume exterior of the pouch and the interior of said pouch, said propellant means in said flexible pouch being a single propellant means and identical to the propellant means in said volume of the container exterior to said pouch.

2. Device according to claim 1, wherein the pouch (9) is made of one of the materials belonging to the group: polyethylene, polypropylene, polyethylene/terephthalate.

3. Device according to claim 1, wherein the pouch (9) comprises a combination of polyolefin films.

4. Device according to claim 1, wherein the thickness of the pouch (9) is between 0.2 and 0.6 mm, according to the nature of the material used to form the pouch.

5. Device according to claim 1, wherein the container (3) comprises in its wall, particularly in its base (6), a filling orifice (7) closed by a filling plug (8).

6. Device according to claim 1, wherein the pouch comprises a combination of polyester films.

* * * * *

UNITED STATES PATENT AND TRADEMARK OFFICE

CERTIFICATE OF CORRECTION

PATENT NO. : 5,277,336
DATED : January 11, 1994
INVENTOR(S) : Jean-Pierre Yquel

It is certified that error appears in the above-indentified patent and that said Letters Patent is hereby corrected as shown below:

On the Title page, item [75], inventor: delete "Youel", and insert --Yquel--.

Signed and Sealed this

Seventeenth Day of May, 1994

Bruce Lehman

*Attest:*

BRUCE LEHMAN

*Attesting Officer*

*Commissioner of Patents and Trademarks*